US009572447B2

(12) United States Patent
Pierce

(10) Patent No.: US 9,572,447 B2
(45) Date of Patent: Feb. 21, 2017

(54) CURTAINS AND CLIPS

(76) Inventor: Scott Pierce, Henderson, NV (US)

( * ) Notice: Subject to any disclaimer, the term of this patent is extended or adjusted under 35 U.S.C. 154(b) by 579 days.

(21) Appl. No.: 13/553,718

(22) Filed: Jul. 19, 2012

(65) Prior Publication Data

US 2013/0019395 A1 Jan. 24, 2013

Related U.S. Application Data

(60) Provisional application No. 61/509,962, filed on Jul. 20, 2011, provisional application No. 61/525,305, filed on Aug. 19, 2011.

(51) Int. Cl.
*A47H 13/04* (2006.01)
*A47K 3/38* (2006.01)

(52) U.S. Cl.
CPC ..... *A47H 13/04* (2013.01); *A47K 3/38* (2013.01); *Y10T 16/353* (2015.01)

(58) Field of Classification Search
CPC ..... A47K 3/38; A47H 13/04; A47H 13/02; A47H 13/00
See application file for complete search history.

(56) References Cited

U.S. PATENT DOCUMENTS 345,904 A 7/1886 Kenney
443,981 A * 12/1890 Braren ..... 160/390
1,666,298 A 4/1928 Norris
1,979,674 A * 11/1934 Cowan ..... A47H 13/04 16/87.2
2,094,649 A * 10/1937 Gaines ..... 160/388
2,320,003 A * 5/1943 Madan ..... A47H 13/04 16/87.8
5,186,232 A 2/1993 Zahner
5,355,551 A 10/1994 Schechter et al.
5,586,375 A * 12/1996 Cooperman et al. ..... 24/716
5,787,954 A 8/1998 Herrera
6,189,597 B1 2/2001 Cheng
6,195,816 B1 3/2001 Glassman
6,494,248 B1 12/2002 Zahner
6,530,120 B2 3/2003 Samelson
7,003,848 B2 2/2006 Ho
D591,522 S * 5/2009 Barrese ..... D6/367
(Continued)

OTHER PUBLICATIONS

Search Opinion from European Patent Application No. 15153473.2.

*Primary Examiner* — Janie Loeppke
(74) *Attorney, Agent, or Firm* — FisherBroyles, LLP; Rob L. Phillips

(57) ABSTRACT

A shower curtain (or conventional drapes) and series of clips integral with an upper edge of the shower curtain. The clips are a single pre-fabricated member including a lower/shower curtain portion and upper/hanger portion. The shower curtain portion is configured to retain a shower curtain while the hanger portion is configured to attach to a shower curtain rod. A retention member may be square-shaped, rectangular or the like and may be received by an internal space defined by layers of shower curtain material. The shower curtain portion defines a space and opening for allowing the clip to fit onto a shower curtain rod. Advantageously, when attached to the shower curtain rod using the series of clips described herein, the shower curtain is substantially flat or flush relative to the shower curtain rod and/or the clips are concealed in part or completely from a position outside of the shower/bathtub.

9 Claims, 11 Drawing Sheets

(56) References Cited

U.S. PATENT DOCUMENTS

| | | | | |
|---|---|---|---|---|
| 7,735,189 | B2 * | 6/2010 | Richardson | 16/87.2 |
| 2007/0277355 | A1 | 12/2007 | Richardson | |
| 2009/0302182 | A1 | 12/2009 | Cittadino | |
| 2010/0018019 | A1 | 1/2010 | Lorenzatti | |
| 2010/0299870 | A1 | 12/2010 | Yeh | |
| 2011/0088231 | A1 * | 4/2011 | Henry | A47K 3/38<br>24/716 |

* cited by examiner

FIG. 10A
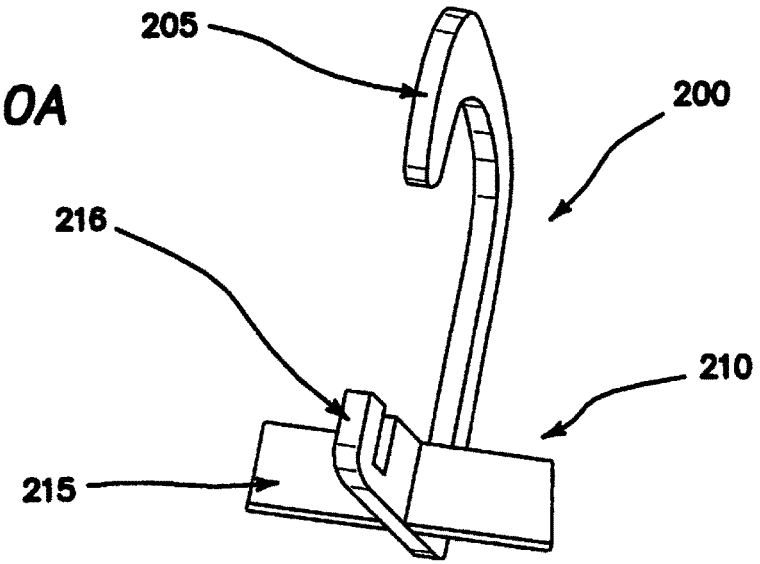
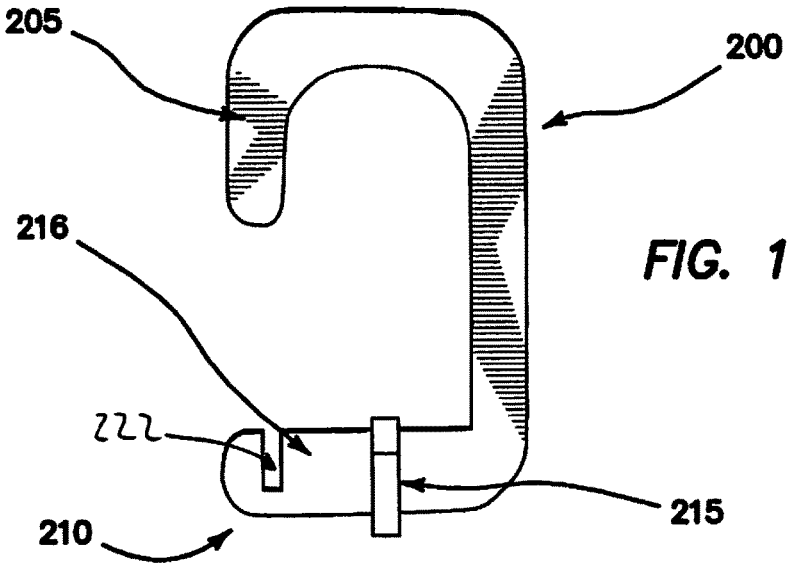
FIG. 10B

CURTAINS AND CLIPS

CROSS REFERENCE

This application claims the benefit of U.S. Provisional Patent Application No. 61/509,962 filed Jul. 20, 2011 and U.S. Provisional Patent Application No. 61/525,305 filed Aug. 19, 2011 both of which are incorporated herein by reference for all purposes.

FIELD OF THE INVENTION

The embodiments of the present invention relate to curtains incorporating novel clips to hang from a curtain rod eliminating cumbersome hooks and loops.

BACKGROUND

Curtains, including shower curtains, have traditionally relied on hooks or loops for attachment to curtain rods. However, hooks and loops are ineffective and/or cumbersome and in some cases require the curtain rod to be removed before the hooks or loops may be placed thereon or alternatively the loops may each need to be opened and placed over the curtain rod.

It would therefore be advantageous to develop a more effective and easy-to-use curtain attachment system.

SUMMARY

Accordingly, the embodiments of the present invention involve a shower curtain and series of clips integral with an upper edge of the shower curtain. The clips are a single pre-fabricated member including a lower/shower curtain portion and upper/hanger portion. The shower curtain portion is configured to retain a shower curtain while the hanger portion is configured to attach to a shower curtain rod. In one embodiment, the shower curtain portion is a flat square-shaped member which may be sandwiched between opposite shower curtain flaps. The shower curtain portion is positioned substantially orthogonally (i.e., 90°) relative to the flat hanger portion. Other embodiments include a clip with a hook portion, shower curtain portion and rectangular retention member and a clip with a hook portion, shower curtain portion and rib. The shower curtain portion defines a space and opening for allowing the clip to fit onto a shower curtain rod. Advantageously, when attached to the shower curtain rod using the series of clips described herein, the shower curtain is substantially flat or flush relative to the shower curtain rod as opposed to comprising peaks and valleys as with the traditional hooks, loops or similar attachment mechanisms.

Other variations, embodiments and features of the present invention will become evident from the following detailed description, drawings and claims.

BRIEF DESCRIPTION OF THE DRAWINGS

FIGS. 10A and 10B illustrate a front perspective and side view, respectively, of a second clip according to the embodiments of the present invention;

DETAILED DESCRIPTION

Figure 1:
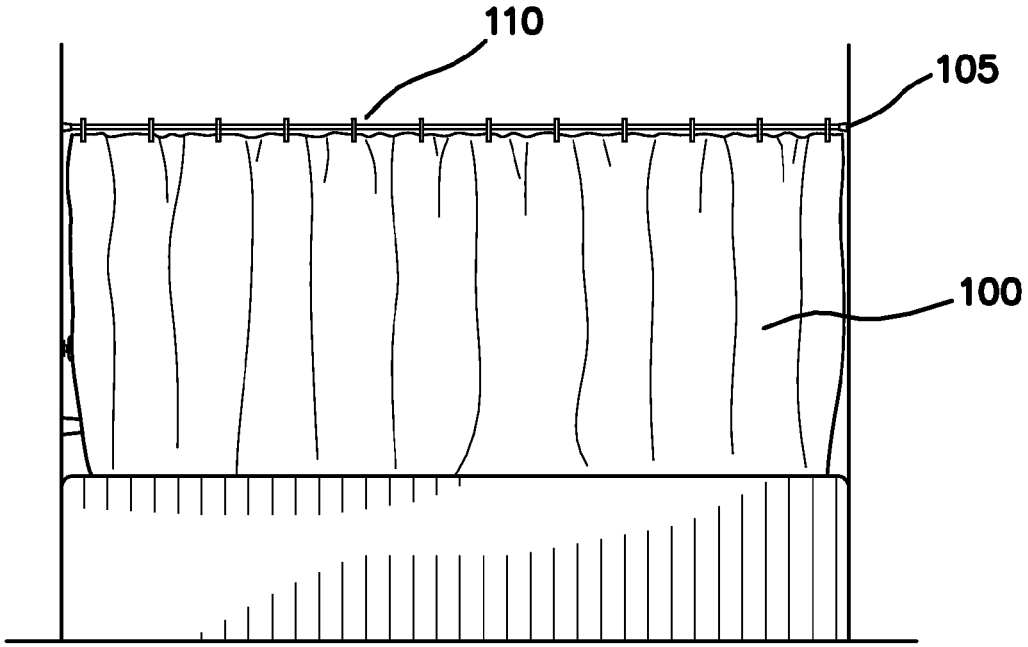
FIG. 1 illustrates a shower curtain attached to a shower curtain rod using a first clip according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The clips described herein may be fabricated of plastic, alloys, metals, polymers, composites and the like using molding, machining, rapid prototyping and similar techniques. In one embodiment, the clips are fabricated of Celcon M-90 allowing the curtain and clips to be washed and dried together without the need for removing the clips. While the detailed description below focuses on shower curtains, conventional curtains (e.g., drapes) are covered by, and benefit from, the embodiments of the present invention.

FIG. 1 shows a shower curtain 100 attached to a shower curtain rod 105 using first clips 110 according to the embodiments of the present invention. The design of the first clip 110 facilitates the shower curtain 100 being flush or flat relative to the shower curtain rod 105. In one embodiment, the first clips 110 are spaced approximately 6 inches along the top of the shower curtain 100. In this manner, the shower curtain 100 may slide along the shower curtain rod 105 allowing ingress and egress for a shower user.

Figure 4:
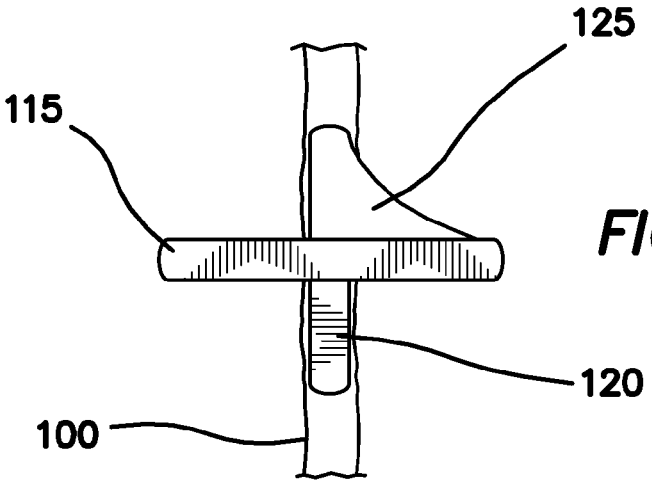
FIGS. 2-4 illustrate a side, rear and top view, respectively, of the first clip according to the embodiments of the present invention.
Figure 2:
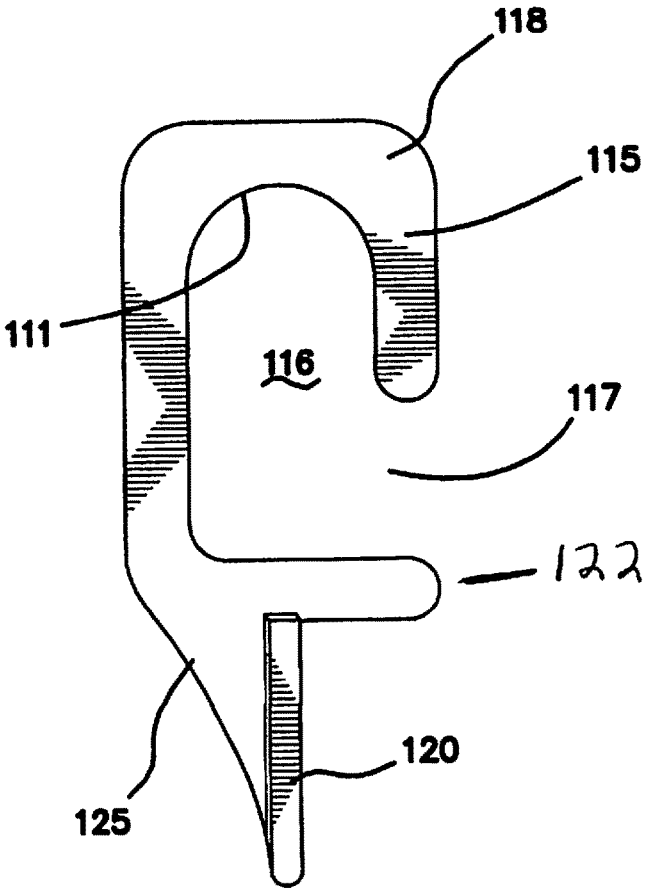
Figure 3:
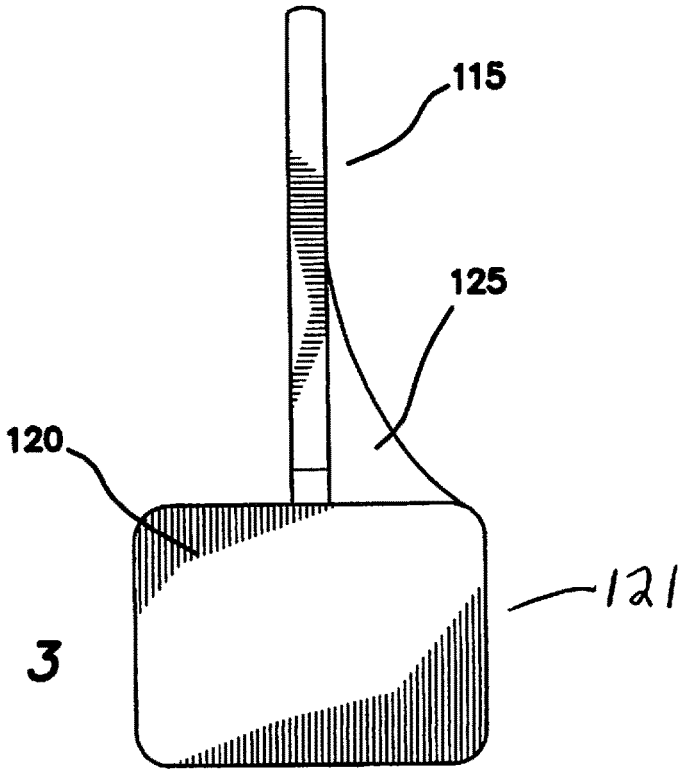

FIGS. 2, 3 and 4 show various views of the first clip 110. FIG. 2 shows a first side view showing a hanger portion 115 and shower curtain portion 120 (curtain portion for conventional drapes). The hanger portion 115 defines a space 116 and opening 117 allowing the clip 110 to be placed on the shower curtain rod 105. In one embodiment, an under surface 118 of the hanger portion 115 of the clip 110 includes a metallic or similar material or coating 111 which facilitates sliding of the clip 110 along the shower curtain rod 105. In one embodiment, a wedge 125 extends from the shower curtain portion 120 to the hanger portion 115. The wedge 125 adds stability to the clip 110.

In one embodiment, the shower curtain portion 120 comprises a square-shaped member 121 and lower horizontal member 122 wherein the square-shaped retention member 121 is received by an elongated internal space 123 defined by an elongated upper portion of the shower curtain 100 and wherein the lower horizontal member 122 extends through one of a series of openings 124 along the upper portion of the shower curtain 100. The internal space 123 is between fabric layers in the upper portion of the shower curtain 100 and permits the clips 110 to retain the shower curtain 100. FIG. 3 also shows the substantially orthogonal (i.e., 90°) relationship between the hanger portion 115 and shower curtain portion 120 as well as the wedge 125 extending therebetween. FIG. 4 shows a top view of the clip 110 with the square-shaped member 121 received by the space 123 in the upper portion of the shower curtain 100.

Figure 5:
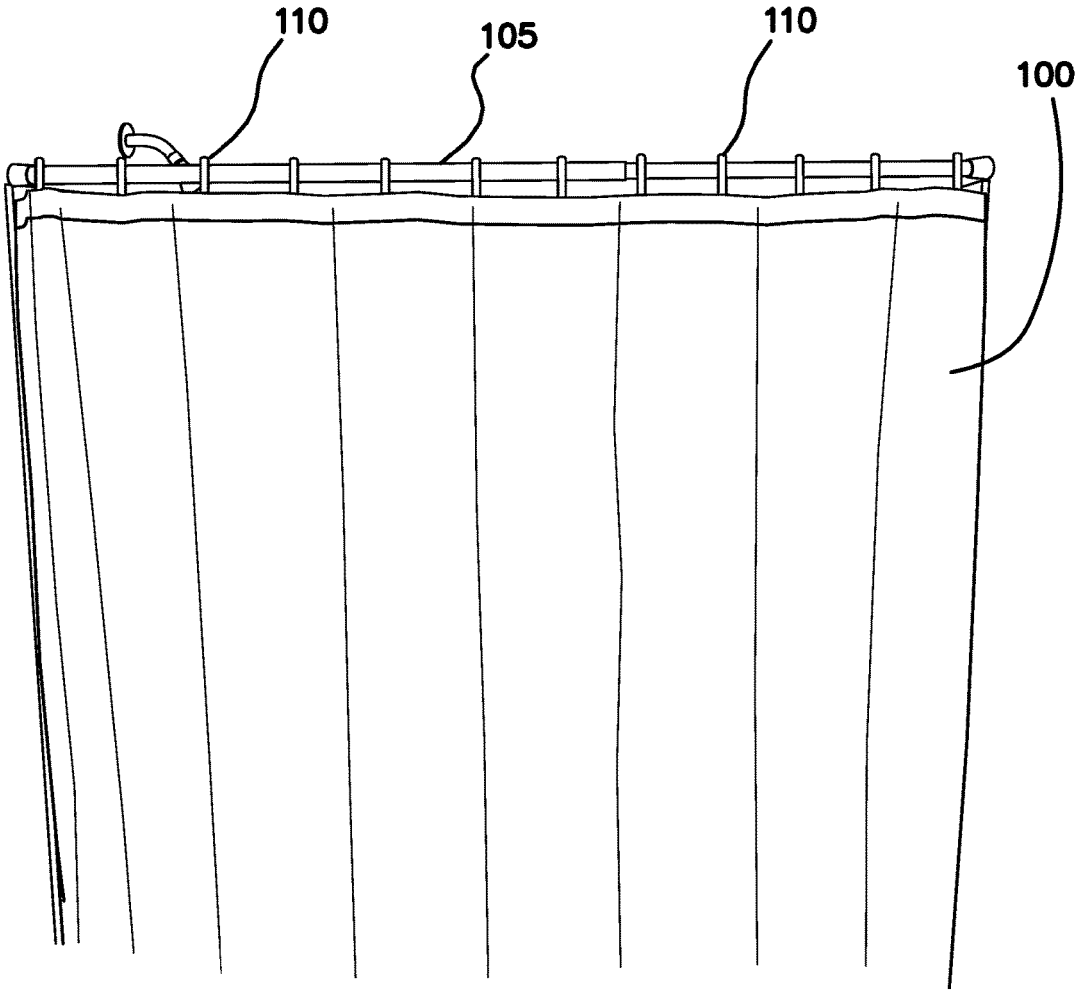
FIG. 5 illustrates a front view of a shower curtain attached to a shower curtain rod using a plurality of the first clips according to the embodiments of the present invention.
Figure 6:
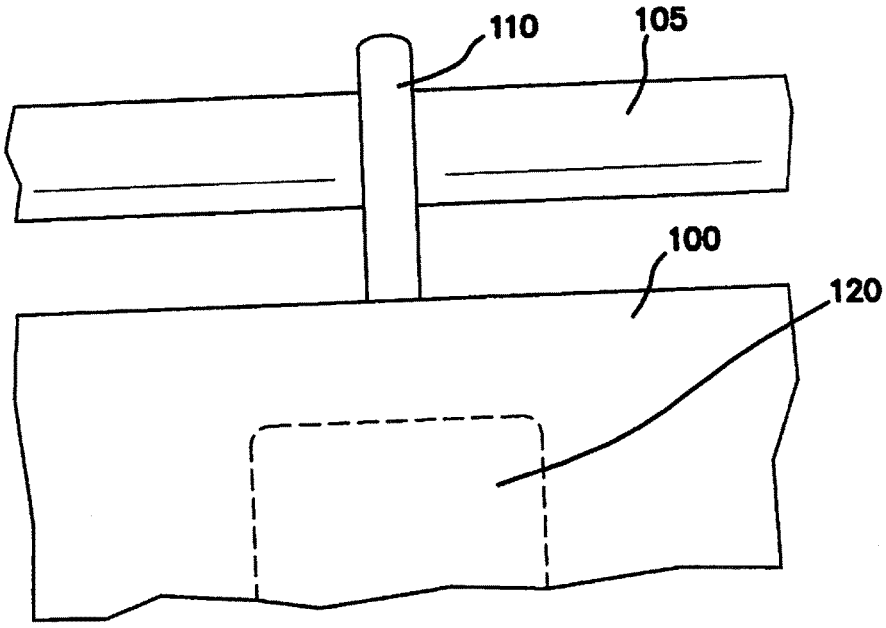
FIGS. 6 and 7 illustrate close-up front and perspective views of the first clips integrated with a shower curtain according to the embodiments of the present invention.
Figure 7:
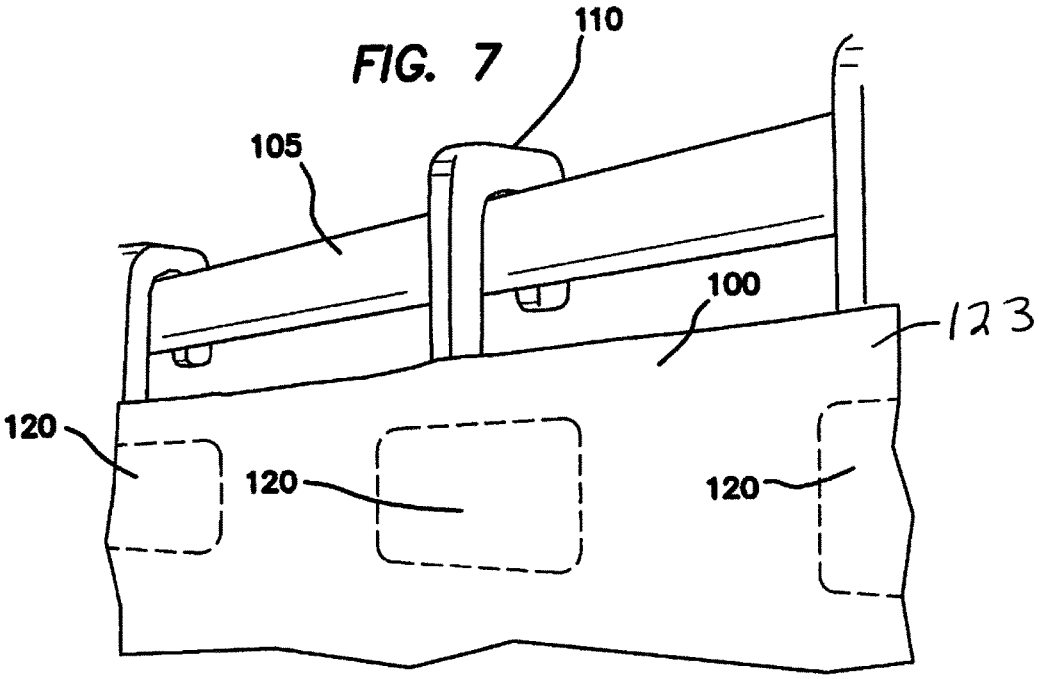
Figure 8:
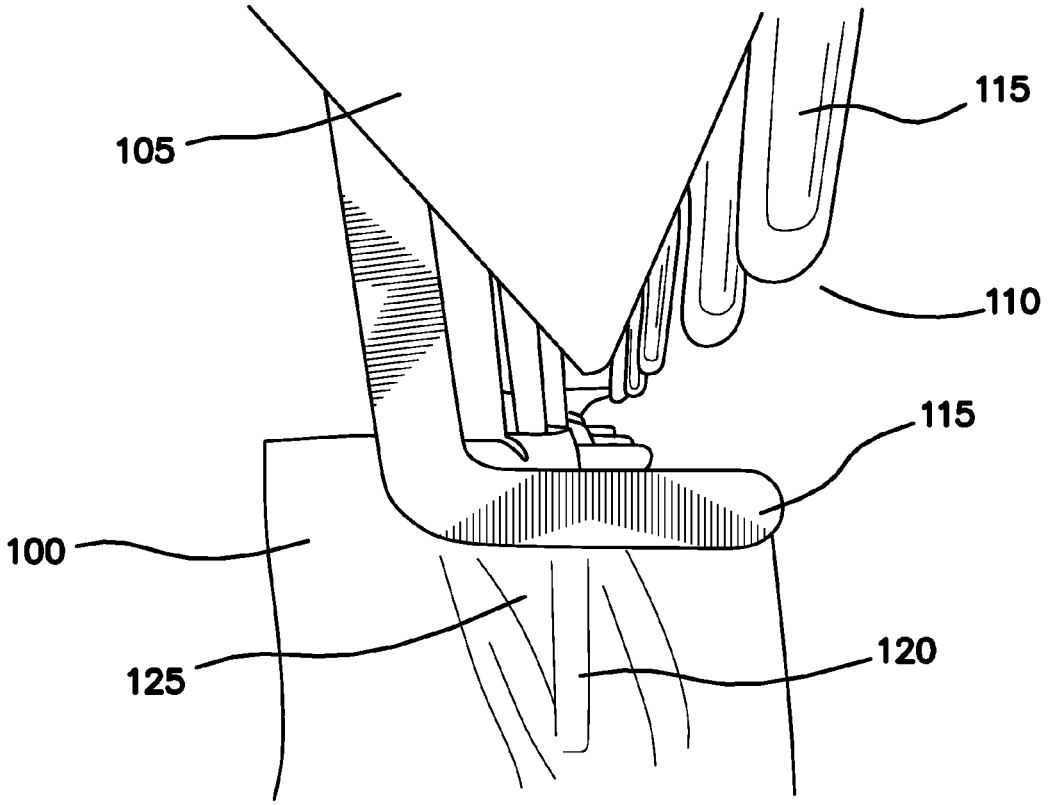
FIG. 8 illustrates a view along a shower curtain rod with the shower curtain hanging from the first clips according to the embodiments of the present invention.
Figure 9:
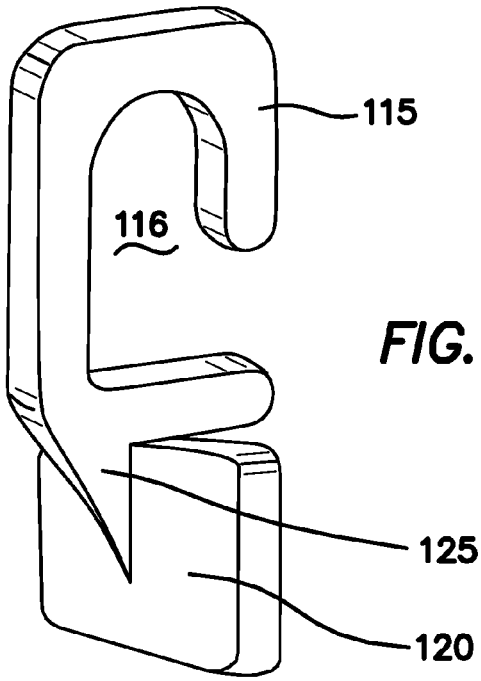
FIG. 9 illustrates a perspective view of the first clip according to the embodiments of the present invention.
Figure 11A:
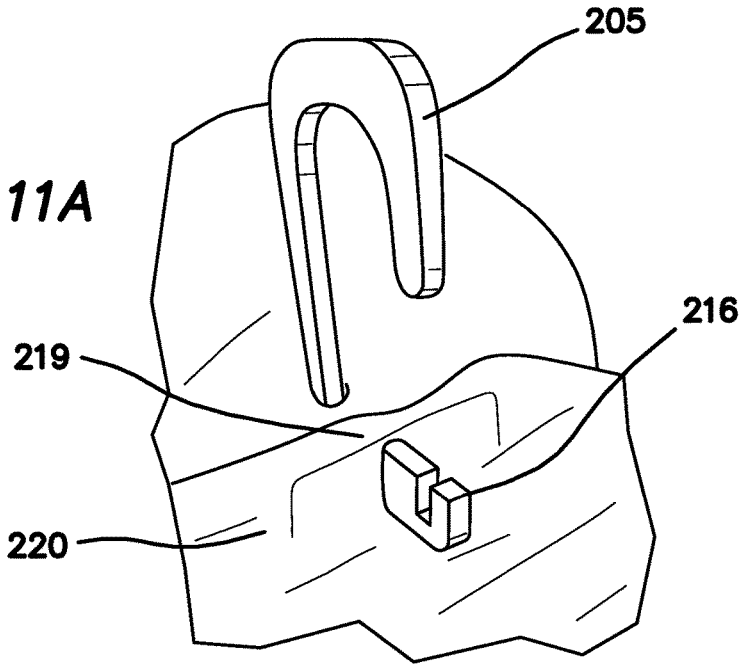
FIGS. 11A and 11B illustrate a perspective front and perspective rear view, respectively, of the second clip integrated with a shower curtain according to the embodiments of the present invention.
Figure 11B:
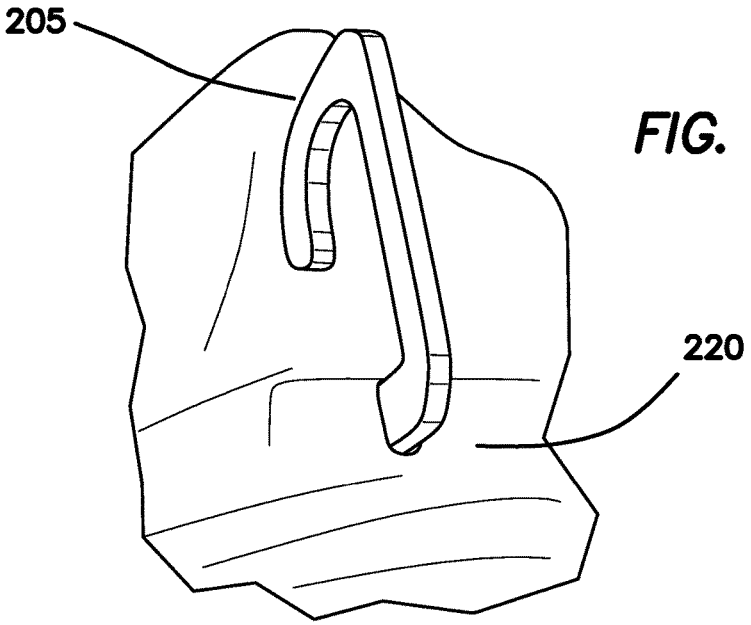

FIG. 5 illustrates a front view of a shower curtain attached to a shower curtain rod 105 using the first clips 110 according to the embodiments of the present invention. As shown, the shower curtain portion 120 is concealed by the shower curtain 100 providing a clean, smooth look. FIGS. 6 and 7 illustrate close-up front and perspective views of the square-shaped member 121 (represented by dotted lines) integrated within the shower curtain 100. FIG. 8 illustrates a view along a shower curtain rod 105 with the shower curtain 100 hanging thereon and FIG. 9 illustrates a rear perspective view of the first clip 110 according to the embodiments of the present invention.

For aesthetics purposes, the hanger portion 115 of the clip 110, may be covered in shower curtain material matching the shower curtain 100.

Figure 12A:
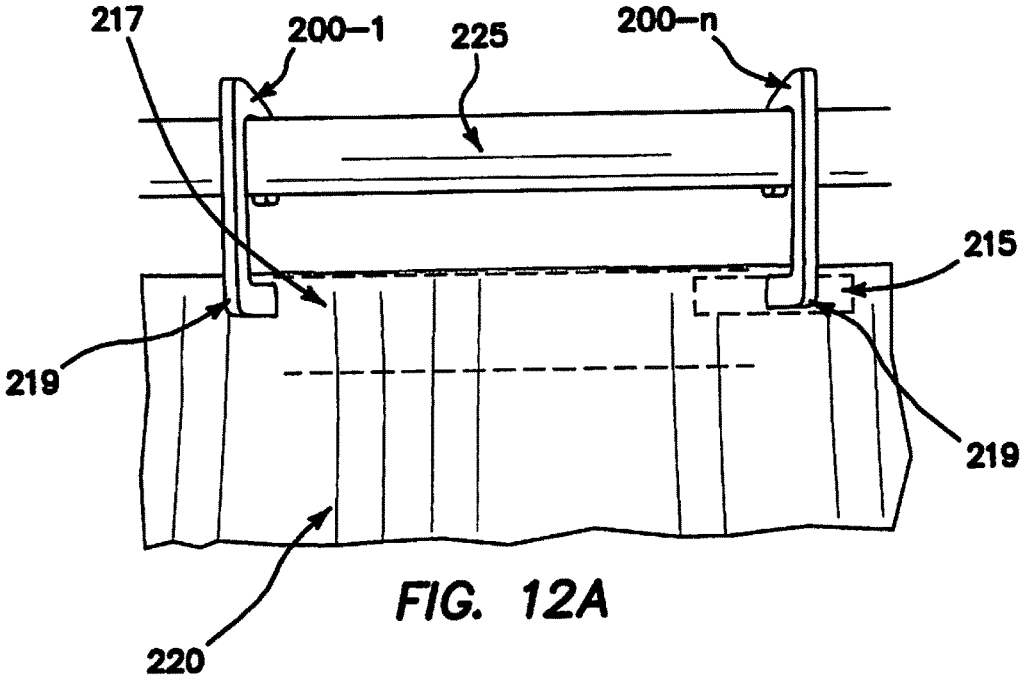
FIGS. 12A and 12B illustrate front and rear views of the second clip integrated with a shower curtain hanging on a shower curtain rod according to the embodiments of the present invention.
Figure 12B:
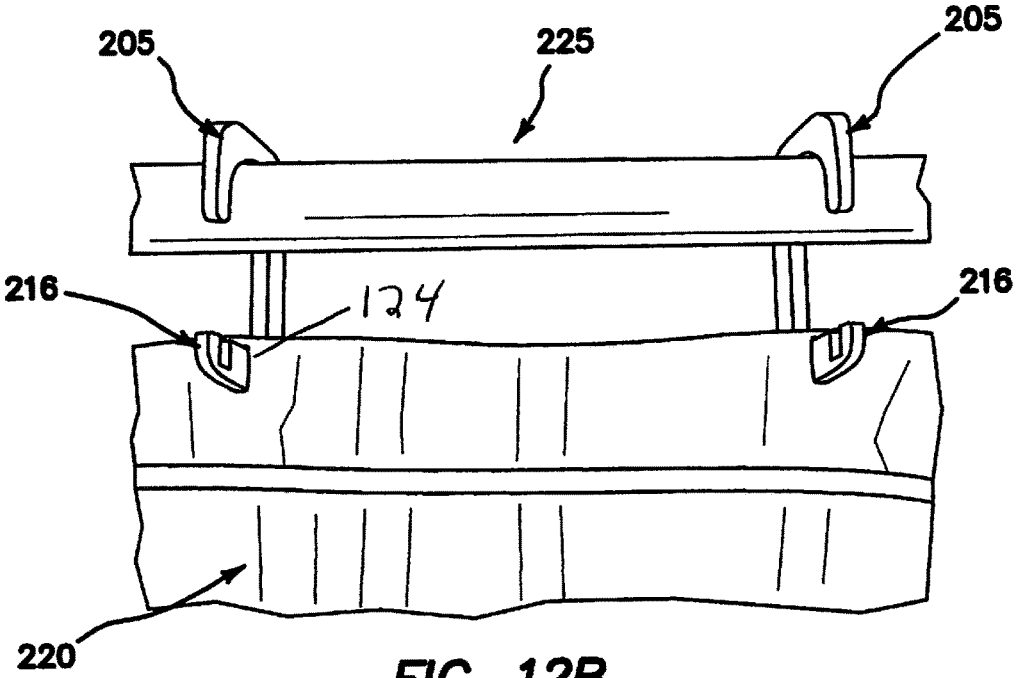

FIGS. 10A and 10B illustrate perspective front and side views, respectively, of a second shower curtain clip 200 according to the embodiments of the present invention. The second clip 200 includes a hook portion 205 configured to hook over and slide along a shower curtain rod. A lower shower curtain portion 210 (curtain portion for conventional drapes) of the clip 200 includes a rectangular retention member 215 and intersecting lower horizontal member 216 configured to retain a shower curtain. A cut-out 222 on said lower horizontal member 216 accepts a shower curtain liner which hangs adjacent to the shower curtain thereby allowing the shower curtain liner to be easily removed and replaced or washed separately. Such a configuration is ideal for seniors and handicap persons given the ease with which the curtain may be removed and washed as well as the ease with which the liner may be removed and reattached. With a conventional curtain, the cut-out 222 may allow a shade or similar article to be hung behind the curtain. As shown in FIGS. 11A-11B and 12A-12B, the rectangular retention member 215 (identified in FIG. 12A by dotted lines) inserts into an elongated internal space 217 (identified in FIG. 12A by dotted lines) defined by an elongated upper portion of a shower curtain 220 and wherein the lower horizontal member 216 extends through one of a series of openings 219 along the upper portion of the shower curtain 220 thereby concealing the rectangular retention member 215 (similar to square-shaped retention member 121 of the first clip 100). FIGS. 12A and 12B show front (i.e., from outside the bathtub/shower) and rear (from within the bathtub/shower) views of a plurality of the second clips 200-1 through 200-N supporting a shower curtain 215 attached to a shower curtain rod 225.

Figure 13A:
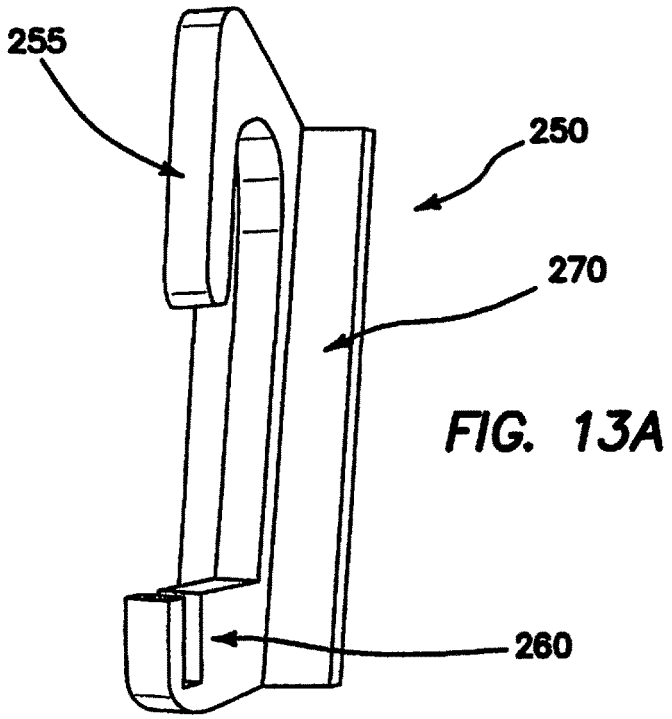
FIGS. 13A and 13B illustrate a perspective front and side view, respectively, of a third clip according to the embodiments of the present invention.
Figure 13B:
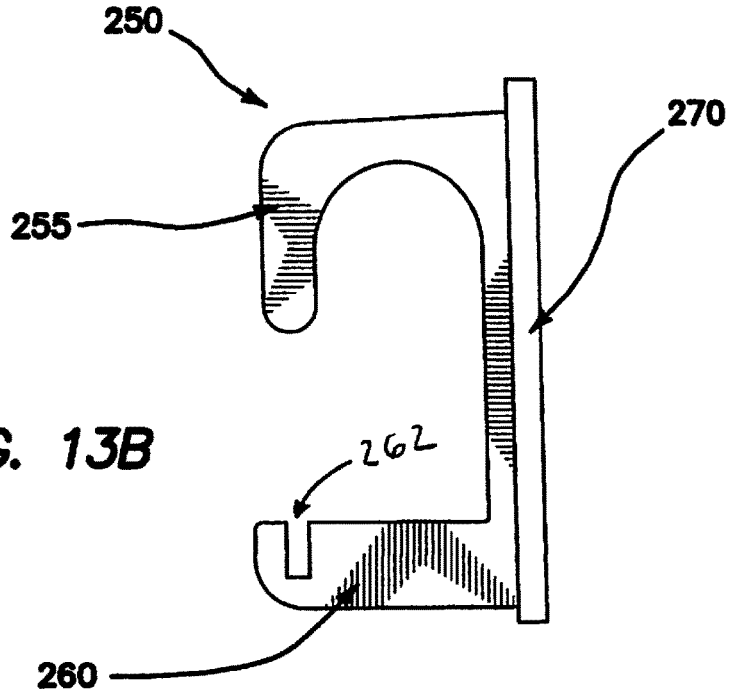

FIGS. 13A and 13B illustrate front and side views, respectively, of a third shower curtain clip 250 according to the embodiments of the present invention. The third clip 250 includes a hook portion 255 configured to hook over and slide along a shower curtain rod and a horizontal lower member 260. A cut-out 262 on said horizontal lower member 260 accepts a shower curtain liner which hangs adjacent to the shower curtain thereby allowing the shower curtain liner to be easily removed and replaced or washed separately. A rib 270 supports the hook portion 255 and horizontal lower member 260.

Figure 14:
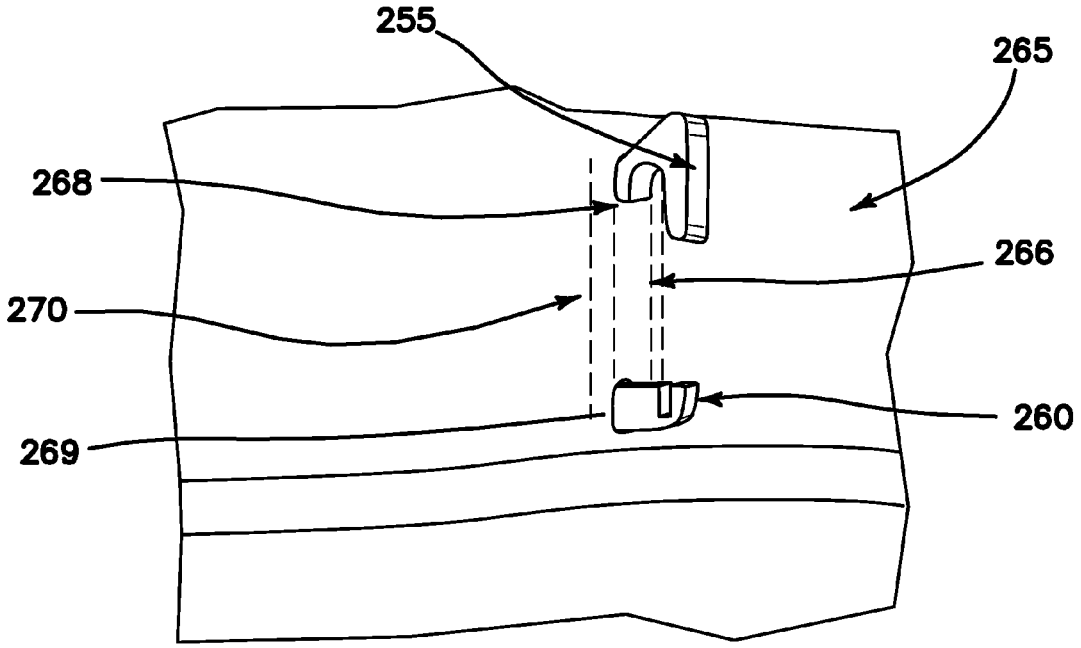
FIG. 14 illustrates the third clip integrated with a shower curtain according to the embodiments of the present invention.

FIG. 14 illustrates the third clip 250 integrated with a shower curtain 265 according to the embodiments of the present invention. As shown, the rib 270 is received by a space 266 (identified in FIG. 14 by dotted lines) in an upper portion of the shower curtain 265 thereby concealing the rib 270 (identified in FIG. 14 by dotted lines). The hook portion 255 and horizontal lower member 260 extend outward from upper openings 268 and lower openings 269, respectively, in the upper portion of the shower curtain 265.

Figure 15A:
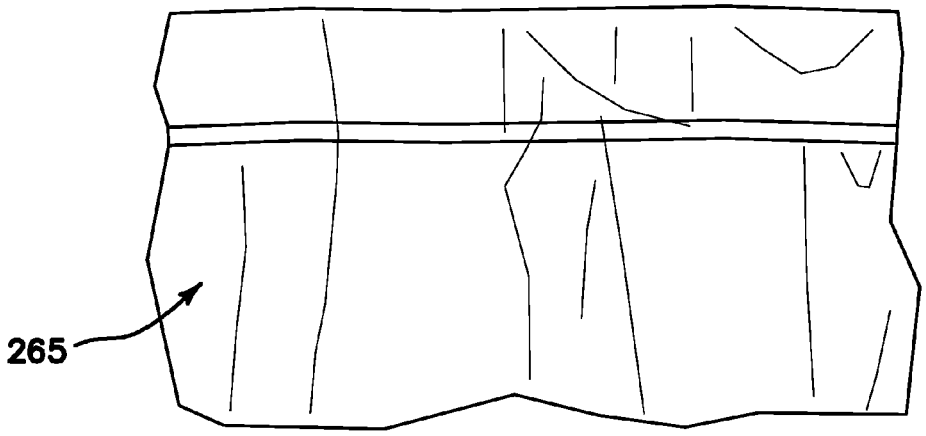
FIGS. 15A and 15B illustrate front and rear views of the shower curtain hanging on a shower curtain rod with the third clips in place according to the embodiments of the present invention.
Figure 15B:
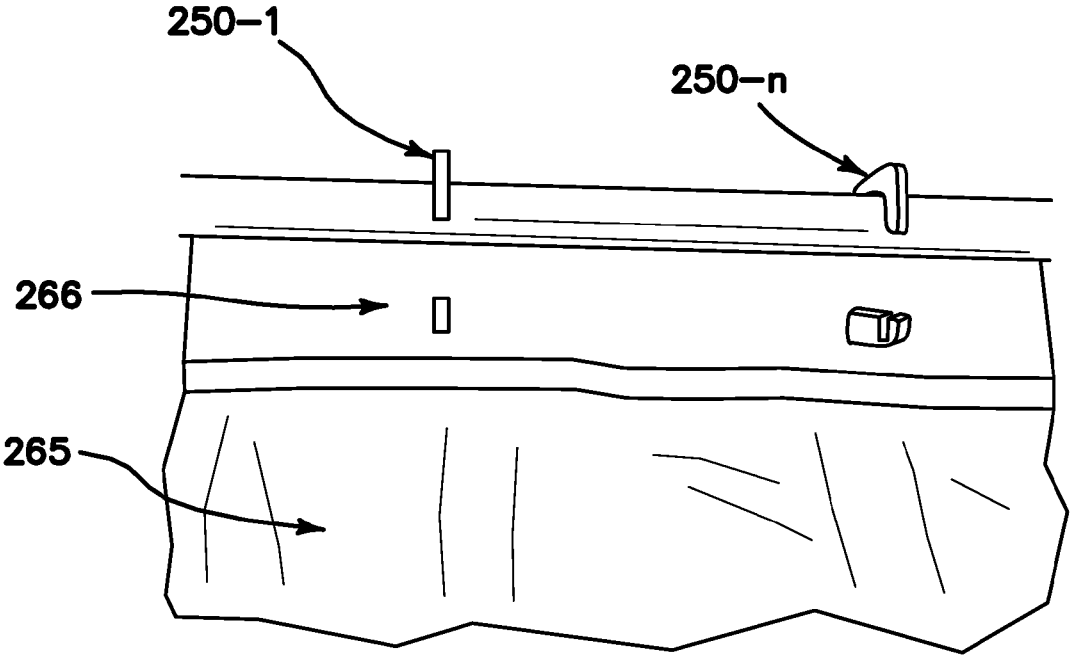

FIGS. 15A and 15B illustrate front (i.e., from outside the bathtub/shower) and rear (from within the bathtub/shower) views of the shower curtain 265 hanging on a shower curtain rod 225 with a plurality of third clips 250-1 through 250-N in place according to the embodiments of the present invention. As shown, the third clips 250-1 through 250-N are not visible at all from outside the bathtub/shower thereby creating an aesthetically pleasing smooth and clean appearance.

With the embodiments of the present invention, the clips 110, 200 and 250 have portions which insert into an internal space within an upper portion of the shower curtain. The internal space may run the length of the upper portion or may comprise individual, separate spaces positioned along the upper portion.

The embodiments of the present invention reduce or eliminate problems with conventional hooks including disengagement of hooks from the curtain rod.

Although the invention has been described in detail with reference to several embodiments, additional variations and modifications exist within the scope and spirit of the invention as described herein.

I claim:

1. A curtain comprising:

an upper portion defining an internal space, said internal space defined by a front section and a rear section;

an upper row of one or more spaced openings positioned along said rear section of said upper portion;

a lower row of spaced openings positioned along said rear section of said upper portion, said lower row of spaced openings aligned vertically with said upper row of spaced openings;

a series of C-shaped clips, said clips each comprising a hanger portion and curtain portion, said hanger portion defining a space and opening, said space for permitting said hanger portion to slidably engage a curtain rod, said curtain portion including a planar-shaped retention member positioned below said hanger portion and orthogonally relative thereto, said planar-shaped retention member extending in opposite directions longitudinally within said internal space and substantially concealed within and secured by said internal space with at least a section of said hanger portion extending through a spaced opening in said upper row of spaced openings in said upper portion exposed for engaging a curtain rod, said curtain portion positioned to extend through a vertically aligned one of said one or more spaced openings in said lower row of spaced openings in said upper portion, said hanger portion and said curtain portion extending in a same direction generally perpendicular to a surface of said curtain and directly beneath and parallel to an upper section of said hanger portion; and wherein when said curtain is attached to a curtain rod said clips are concealed by said front section.

2. The curtain of claim 1 wherein said curtain is a shower curtain.

3. A curtain comprising:

an upper portion defining an internal space, said internal space defined by a front section and a rear section;

an upper row of one or more spaced openings positioned along said rear section of said upper portion;

a lower row of spaced openings positioned along said rear section of said upper portion, said lower row of spaced openings aligned vertically with said upper row of spaced openings;

a series of C-shaped clips, said clips each comprising a hanger portion and curtain portion, said hanger portion defining a space and opening, said space for permitting said hanger portion to slidably engage a curtain rod, said curtain portion including an elongated retention member orthogonally positioned relative to said hanger portion, said elongated retention member extending in opposite directions longitudinally within said internal space and substantially concealed within and secured by said internal space with at least a section of said hanger portion extending through a spaced opening in said upper row of spaced openings in said upper portion exposed for engaging a curtain rod, said curtain portion further including a lower horizontal member intersecting said elongated retention member and positioned to extend through an aligned one of said one or more spaced openings in said lower row of spaced openings in said upper portion, said section of said hanger portion and said curtain portion extending in a same direction generally perpendicular to a surface of said curtain and directly beneath and parallel to an upper section of said hanger portion; and wherein when said curtain is attached to a curtain rod said clips are concealed by said front section.

4. The curtain of claim 3 wherein said elongated retention member is rectangular.

5. The curtain of claim 3 wherein said curtain is a shower curtain.

6. The curtain of claim 5 wherein said lower horizontal member includes a cut-out configured to receive a shower curtain liner.

7. A curtain comprising:

an upper portion defining an internal space, said internal space defined by a front section and a rear section;

a series of upper spaced and lower spaced openings positioned along said upper portion;

a lower row of spaced openings positioned along said rear section of said upper portion, said lower row of spaced openings aligned vertically with said upper row of spaced openings;

a series of clips, said clips each comprising a hanger portion and lower horizontal member, said hanger portion defining a space and opening, said space for permitting said hanger portion to slidably engage a curtain rod;

a planar-shaped rib supporting said hanger portion and lower horizontal member, said planar-shaped rib received and substantially concealed within and secured by said internal space wherein said hanger portion of each clip extends through one of said one or more upper spaced openings and said lower horizontal member of each clip extends through one of said one or more spaced aligned lower openings in a direction generally perpendicular to a surface of said curtain, said hanger portion and lower horizontal member extending in a same direction; and wherein when said curtain is attached to a curtain rod said clips are concealed by said front section.

8. The curtain of claim 7 wherein said curtain is a shower curtain.

9. The curtain of claim 8 wherein said lower horizontal member includes a cut-out configured to receive a shower curtain liner.

* * * * *